US009657480B1

(12) United States Patent
Inzeo

(10) Patent No.: US 9,657,480 B1
(45) Date of Patent: May 23, 2017

(54) HIGH SNOW-LOAD RIDGE VENTILATOR

(75) Inventor: Joseph A. Inzeo, West Allis, WI (US)

(73) Assignee: METAL-ERA, INC., Waukesha, WI (US)

( * ) Notice: Subject to any disclaimer, the term of this patent is extended or adjusted under 35 U.S.C. 154(b) by 1230 days.

(21) Appl. No.: 13/253,216

(22) Filed: Oct. 5, 2011

Related U.S. Application Data

(63) Continuation-in-part of application No. 11/836,839, filed on Aug. 10, 2007, now Pat. No. 8,075,376.

(60) Provisional application No. 60/878,771, filed on Jan. 5, 2007.

(51) Int. Cl.

| | |
|---|---|
| ***F24F 13/08*** | (2006.01) |
| ***E04D 13/158*** | (2006.01) |
| ***F24F 7/02*** | (2006.01) |
| ***E04D 13/17*** | (2006.01) |

(52) U.S. Cl.
CPC ..... *E04D 13/158* (2013.01); *E04D 13/174* (2013.01); *F24F 7/02* (2013.01)

(58) Field of Classification Search
CPC ..... E04D 13/158; E04D 13/174; E04D 3/40; F24F 7/02; F24F 2007/001; F24F 3/056; F24F 7/06
USPC ..... 454/364, 365, 366
See application file for complete search history.

(56) References Cited

U.S. PATENT DOCUMENTS

| | | | | |
|---|---|---|---|---|
| 5,427,571 A | | 6/1995 | Sells | |
| 5,924,925 A | * | 7/1999 | Nystrom | 454/365 |
| 6,077,159 A | * | 6/2000 | Clayton | 454/250 |

FOREIGN PATENT DOCUMENTS

DE 3511798 A1 * 12/1985

* cited by examiner

*Primary Examiner* — Steven B McAllister
*Assistant Examiner* — Reginald McNeill, II
(74) *Attorney, Agent, or Firm* — Donald J. Ersler

(57) ABSTRACT

A high snow-load ridge ventilator includes a pair of support brackets, a perforated support, a ridge cover and a plurality of cover spacers. A bottom of one support bracket is attached to one side of a ventilation opening and a bottom of the other support bracket is attached to the other side of the ventilation opening. A plurality of perforated support spacers may be attached to the roof along a length of a pair of support brackets to provide additional load carrying capability. The perforated support is a formed plate with a plurality of perforated openings. The perforated support is attached to a top of the pair of support brackets. The plurality of cover spacers are attached to a top of the perforated support. The ridge cover includes snap clips that are sized to receive snap flanges extending from the perforated support.

17 Claims, 18 Drawing Sheets

HIGH SNOW-LOAD RIDGE VENTILATOR

CROSS-REFERENCES TO RELATED APPLICATIONS

This is a continuation-in-part patent application taking priority from patent application Ser. No. 11/836,839 filed on Aug. 10, 2007, which takes priority from provisional application No. 60/878,771 filed on Jan. 5, 2007.

BACKGROUND OF THE INVENTION

Field of the Invention

The present invention relates generally to roof ventilation and more specifically to a high snow-load ridge ventilator, which may be modified to accommodate different roof pitches and air flow requirements.

Discussion of the Prior Art

Proper ventilation of a roof prevents premature failure of roofing materials (such as shingles) due to excessive heat; moisture due to condensation, thus preventing a major source of mold and mildew; and ice damming in cold climates, which also leads to premature failure of roofing materials. Some of the factors that dictate ventilation requirements include roof size, attic space area, length of roof ridge, length of roof eaves, pitch of roof, the amount of insulation below the roof, exposure to sun, climate, humidity and temperature extremes.

There are numerous ridge ventilators in the art. U.S. Pat. No. 5,427,571 to Sells discloses a ventilated cap system for the ridge of a roof. The Sells patent includes an expandable utility cap to seal over a variably expanding metal roof. In one form, a top cap may snap lock over the utility cap for slidable attachment thereto when exposed to deforming forces such as ice or snow. The top cap prevents deformation of the underlying utility cap. However, the Sells ridge ventilator is not easily customizable.

Accordingly, there is a clearly felt need in the art for a high snow-load ridge ventilator, which may be easily modified to accommodate different roof pitches, air flow requirements and potential snow-loading scenarios.

SUMMARY OF THE INVENTION

The present invention provides a high snow-load ridge ventilator, which may be modified to accommodate different roof pitches and air flow requirements. A customizable ridge ventilator includes a pair of support brackets, a perforated support and a ridge cover. Each support bracket has a substantial Z-shaped cross section. A bottom of one support bracket is attached to one side of a ventilation opening and a bottom of the other support bracket is attached to the other side of the ventilation opening. The perforated support is a formed plate with a plurality of perforated openings. The perforated support preferably has a cross section with a support peak, a pair of legs and a pair of snap flanges. One end of a leg extends from a bottom of each side of the support peak. A snap flange extends downward from the other end of each leg. The perforated support is attached to a top of the pair of support brackets with fasteners or the like.

The ridge cover includes a sloped peak, two side legs and a pair of snap clips. One end of a single side leg extends downward from each end of the sloped peak. A single snap clip extends from the other end of each side leg. The pair of snap clips of the ridge cover are slid over the pair of snap flanges of the perforated support. A top of the support peak supports the ridge cover. A cover splice includes a cross section that has the same shape as the ridge cover. The cover splice is sized to be received by an inner perimeter of the ridge cover. Two adjacent ridge covers are connected to each other with the cover splice.

A second embodiment of the customizable ridge ventilator includes a pair of support brackets, the perforated support and the ridge cover. Each support bracket has a substantial C-shaped cross section. The second embodiment of the customizable ridge ventilator includes corrugated roof applications. A bottom of one support bracket is attached to one side of a ventilation opening and a bottom of the other support bracket is attached to the other side of the ventilation opening, such that the open ends face away from each other. The open end of each support bracket is sized to receive a thickness of a corrugated roof panel. The perforated support is attached to a top of the pair support brackets. The pair of snap clips of the ridge cover snap are slid over the pair of snap flanges of the perforated support. A top of the support peak supports the ridge cover. Two adjacent ridge covers are connected to each other with the cover splice.

A high snow-load ridge ventilator includes a pair of support brackets, a perforated support, a ridge cover and a plurality of cover spacers. Each support bracket has a substantial Z-shaped cross section. A bottom of one support bracket is attached to one side of a ventilation opening and a bottom of the other support bracket is attached to the other side of the ventilation opening. A plurality of perforated support spacers may be attached to the roof along a length of the pair of support brackets to provide the high snow-load ridge ventilator with additional load carrying capability. The perforated support is a formed plate with a plurality of perforated openings. The perforated support preferably has a cross section with a pair of legs and a pair of snap flanges. One end of each leg meets the other to form a peak. A single snap flange extends downward from the other end of each leg. The perforated support is attached to a top of the pair of support brackets and the plurality of perforated support spacers (if used) with fasteners or the like.

The ridge cover includes a sloped peak, two side legs and a pair of snap clips. One end of a single side leg extends downward from each end of the sloped peak. A single snap clip extends from the other end of each side leg. The pair of snap clips of the ridge cover are slid over the pair of snap flanges of the perforated support. The plurality of cover spacers are attached to the pair of legs of the perforated support. The plurality of cover spacers are preferably oriented substantially perpendicular to a length of the pair of support brackets. A cover splice includes a cross section that has the same shape as the ridge cover. The cover splice is sized to be received by an inner perimeter of the ridge cover. Two adjacent ridge covers are connected to each other with the cover splice.

Accordingly, it is an object of the present invention to provide a high snow-load ridge ventilator, which may be easily modified to accommodate different roof pitches, air flow requirements and potential snow loading scenarios.

These and additional objects, advantages, features and benefits of the present invention will become apparent from the following specification.

DETAILED DESCRIPTION OF THE PREFERRED EMBODIMENTS

Figure 1:
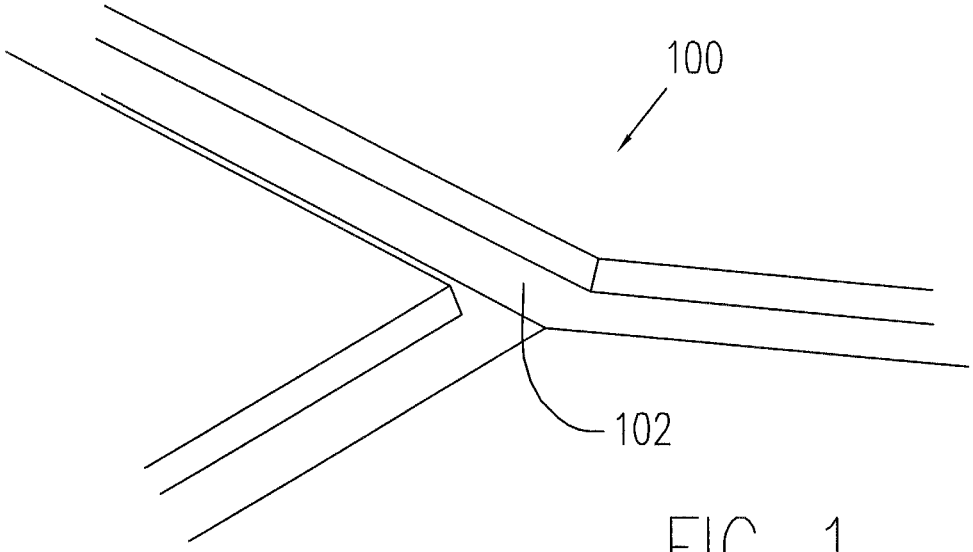
FIG. 1 is a perspective view of a roof with a ventilation opening for attachment of a customizable ridge ventilator in accordance with the present invention.
Figure 2:
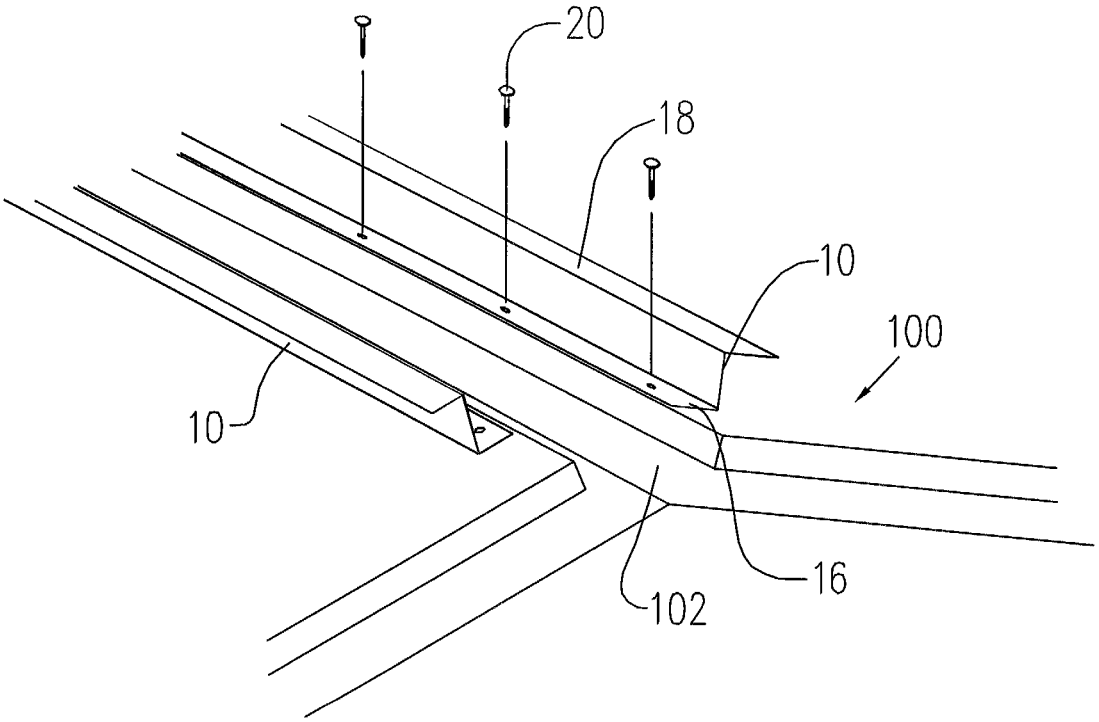
FIG. 2 is a perspective view of a pair of support brackets positioned on a roof of a customizable ridge ventilator in accordance with the present invention.
Figure 3:
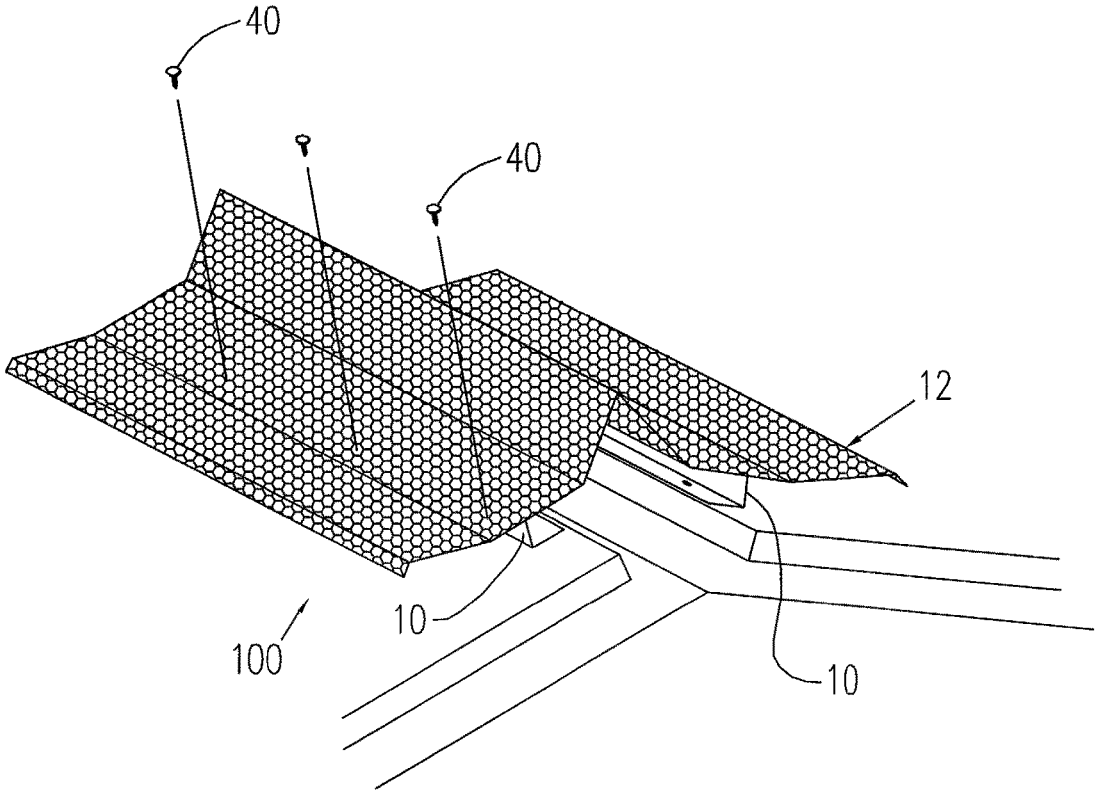
FIG. 3 is a perspective view of a perforated support positioned on a pair of support brackets of a customizable ridge ventilator in accordance with the present invention.
Figure 8:
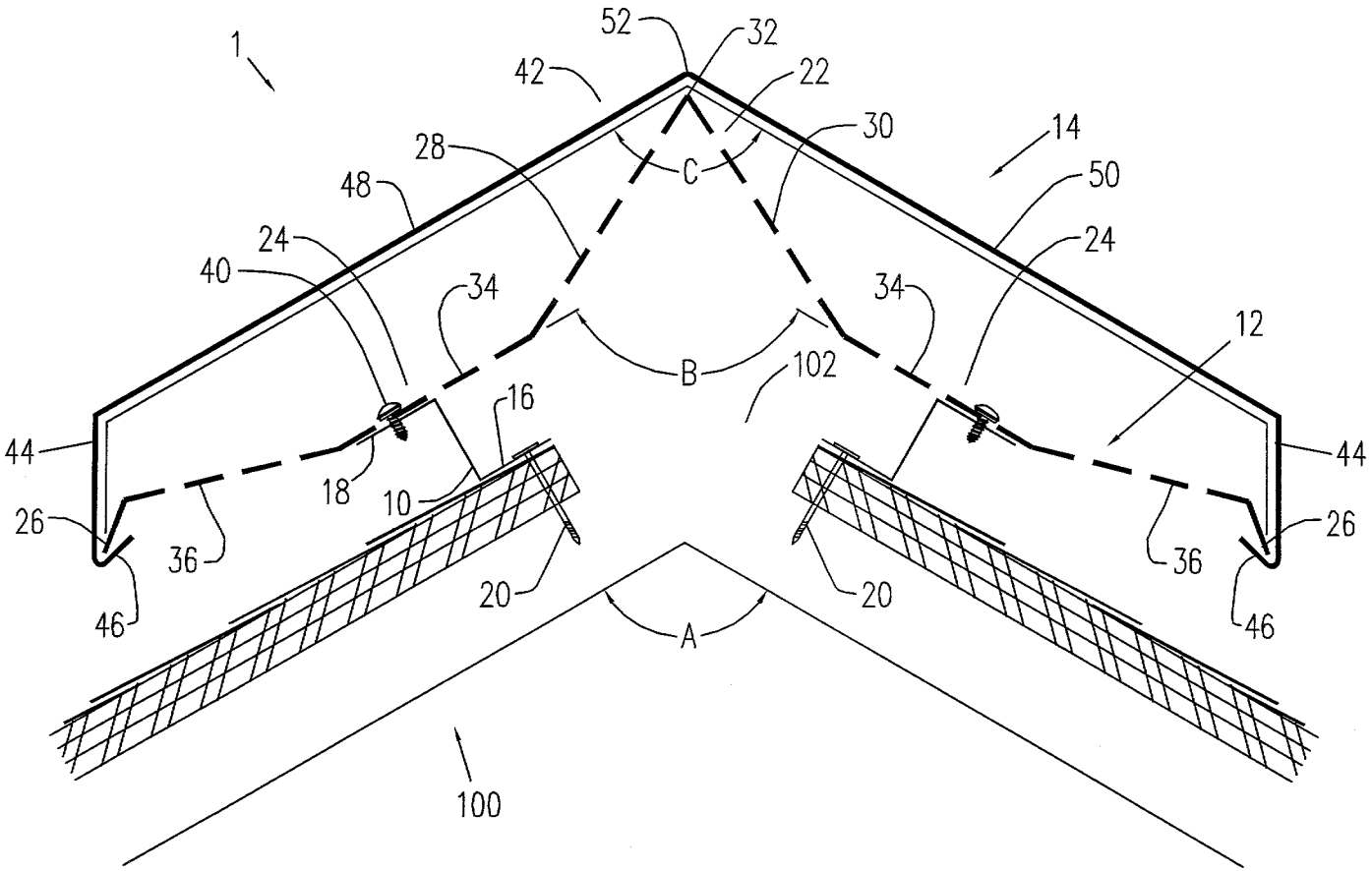
FIG. 8 is an end view of a customizable ridge ventilator attached to a roof in accordance with the present invention.

With reference now to the drawings, and particularly to FIG. 8, there is shown an end view of a customizable roof ventilator 1 attached to a roof 100. With reference to FIGS. 1-3, the customizable ridge ventilator 1 includes a pair of support brackets 10, a perforated support 12 and a ridge cover 14. Each support bracket 10 has a substantial Z-shaped cross section. A bottom flange 16 of the support bracket 10 extends in a direction opposite of the top flange 18 of the support bracket 10. The bottom flange 16 is attached to a top of the roof 100 with a plurality of fasteners 20. One support bracket 10 is attached to one side of a ventilation opening 102 and the other support bracket 10 is attached to the other side of the ventilation opening 102.

The perforated support 12 is a formed plate with a plurality of perforated openings. It is preferable that the plurality of perforated openings occupy 45-55% of the surface area of the perforated support 12. The perforated support 12 preferably has a cross section with a support peak 22, a pair of legs 24 and a pair of snap flanges 26. The support peak 22 includes a first face 28 and a second face 30 that meet at a face peak 32. One end of the leg 24 extends from a bottom of each face of the support peak 22. The leg 24 includes a bracket member 34 and a flange member 36. The snap flange 26 extends downward from the flange member 36. The perforated support 12 is attached to a top of the pair of support brackets 10 by inserting a plurality of threaded fasteners 40 through the pair of bracket members 34 and threading the plurality of threaded fasteners 40 into the top flanges 18 of the pair of support brackets 10.

Figure 6:
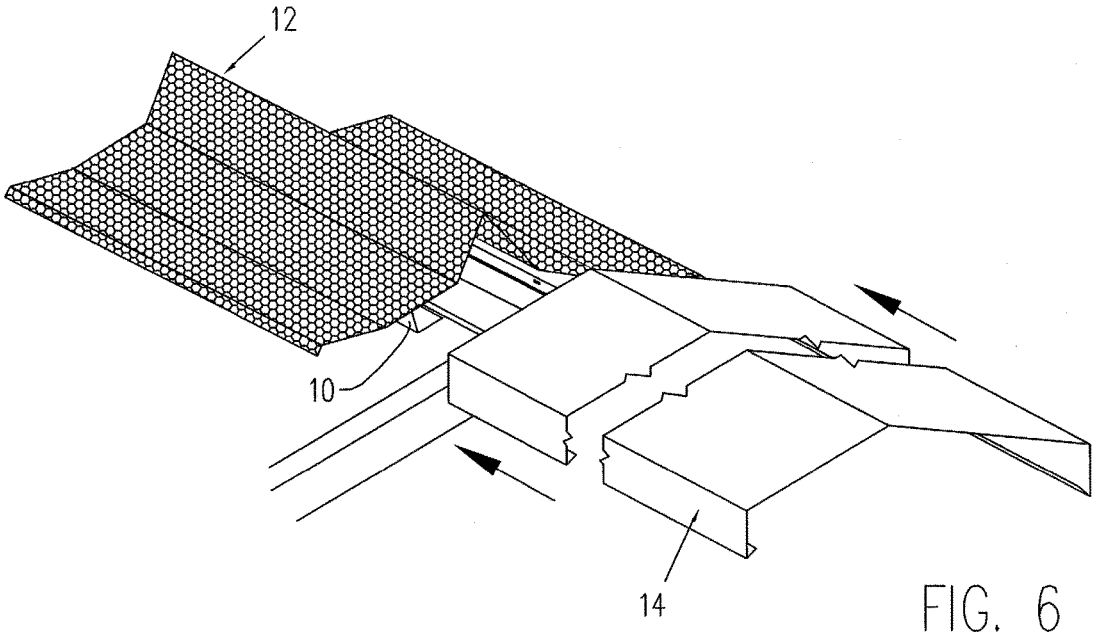
FIG. 6 is a perspective view of a ridge cover adjacent a perforated support of a customizable ridge ventilator in accordance with the present invention.

The ridge cover 14 includes a sloped peak 42, two side legs 44 and a pair of snap clips 46. The sloped peak 42 includes a first face 48 and a second face 50 that meet at a cover peak 52. One end of a single side leg 44 extends downward from each face of the sloped peak 42. Each side leg 44 is terminated with a snap clip 46. With reference to FIG. 6, the pair of snap clips 46 of the ridge cover 14 are slid over the pair of snap flanges 26 of the perforated support 12. The face peak 32 supports an underside of the cover peak 52. The perforated support 12 has sufficient rigidity to support the ridge cover 14.

With reference to FIG. 8, the included angle "A" of the roof 100 is preferably replicated during manufacture of the customizable roof ventilator 1 by defining the included angle "B" of the bracket members 34 of the perforated support 12 as "B"="A" and by defining the included angle "C" of the first and second faces of the ridge cover 14 as "C"="A."

Figure 4:
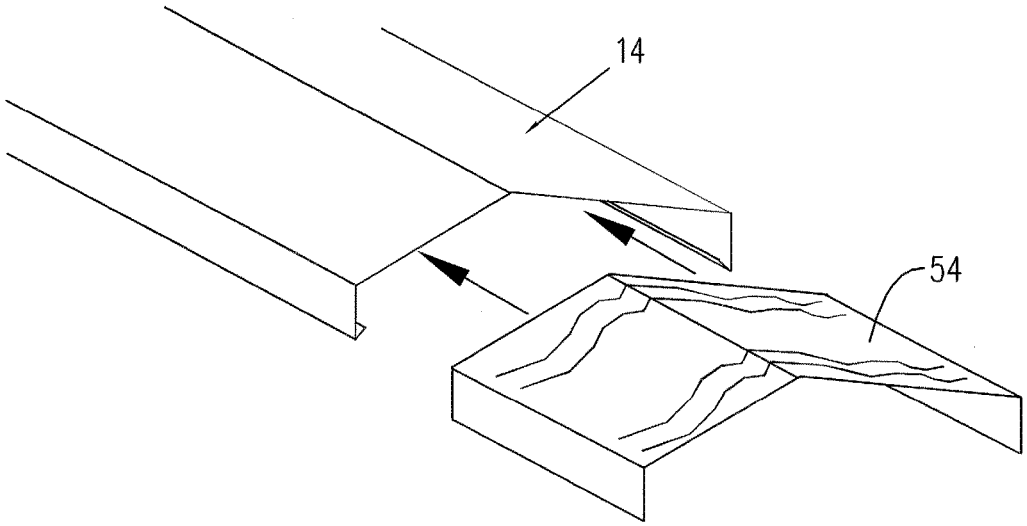
FIG. 4 is a perspective view of a cover splice adjacent a ridge cover of a customizable ridge ventilator in accordance with the present invention.
Figure 5:
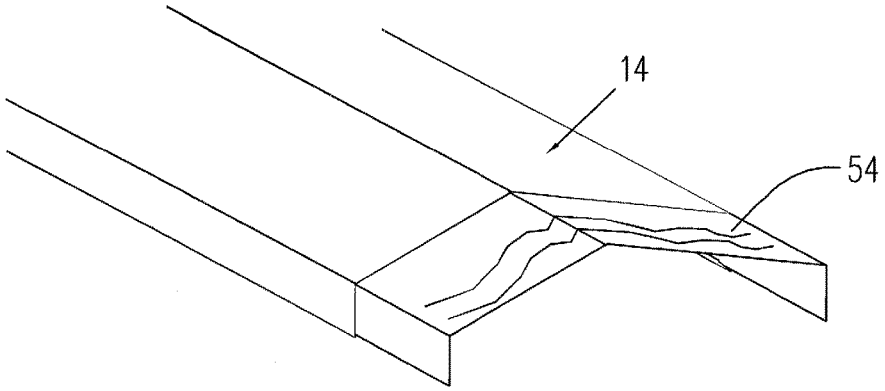
FIG. 5 is a perspective view of a cover splice inserted into a ridge cover of a customizable ridge ventilator in accordance with the present invention.
Figure 7:
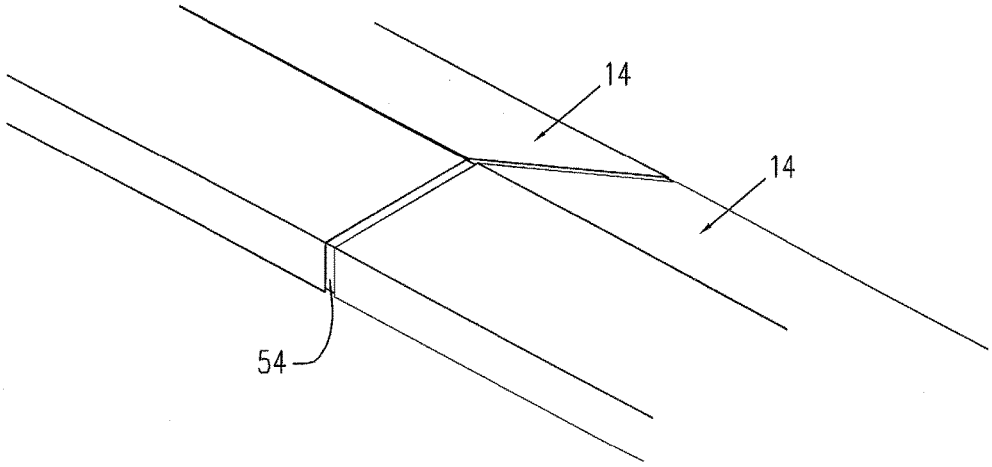
FIG. 7 is a perspective view of two adjacent ridge covers engaged with a cover splice of a customizable ridge ventilator in accordance with the present invention.

With reference to FIGS. 4-5, a cover splice 54 includes a cross section that has the same shape as the ridge cover 14. However, the cover splice 54 does not include a pair of snap clips 46. The cover splice 54 is sized to be received by an inner perimeter of the ridge cover 14. With reference to FIG. 7, two adjacent ridge covers 14 are connected to each other with the cover splice 54.

Figure 9:
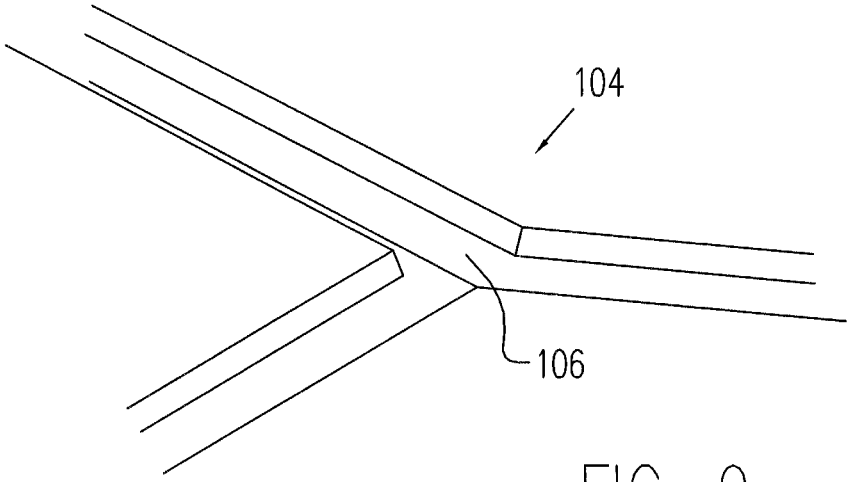
FIG. 9 is a perspective view of a roof with a ventilation opening for attachment of a second embodiment of a customizable ridge ventilator in accordance with the present invention.
Figure 10:
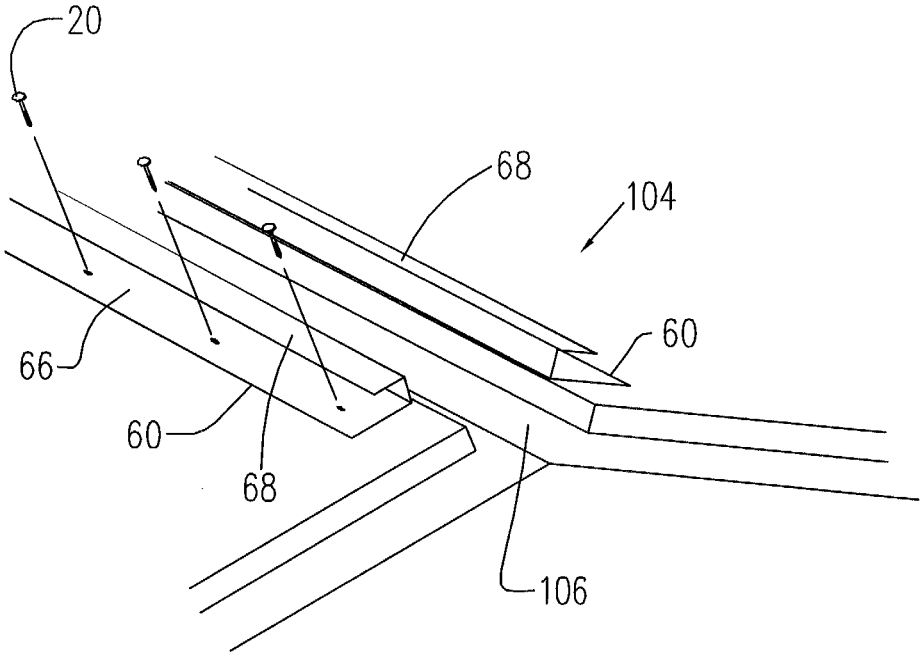
FIG. 10 is a perspective view of a pair of support brackets positioned on a roof of a second embodiment of a customizable ridge ventilator in accordance with the present invention.
Figure 11:
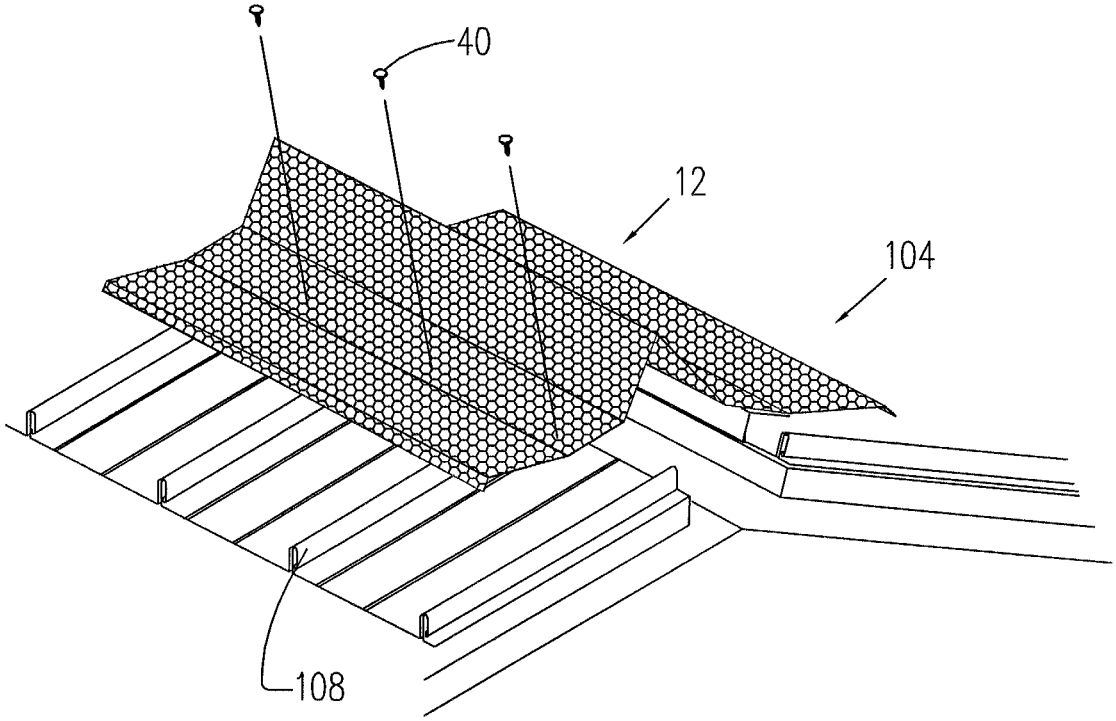
FIG. 11 is a perspective view of a perforated support positioned on a pair of support brackets and over a corrugated roof of a second embodiment of a customizable ridge ventilator in accordance with the present invention.
Figure 16:
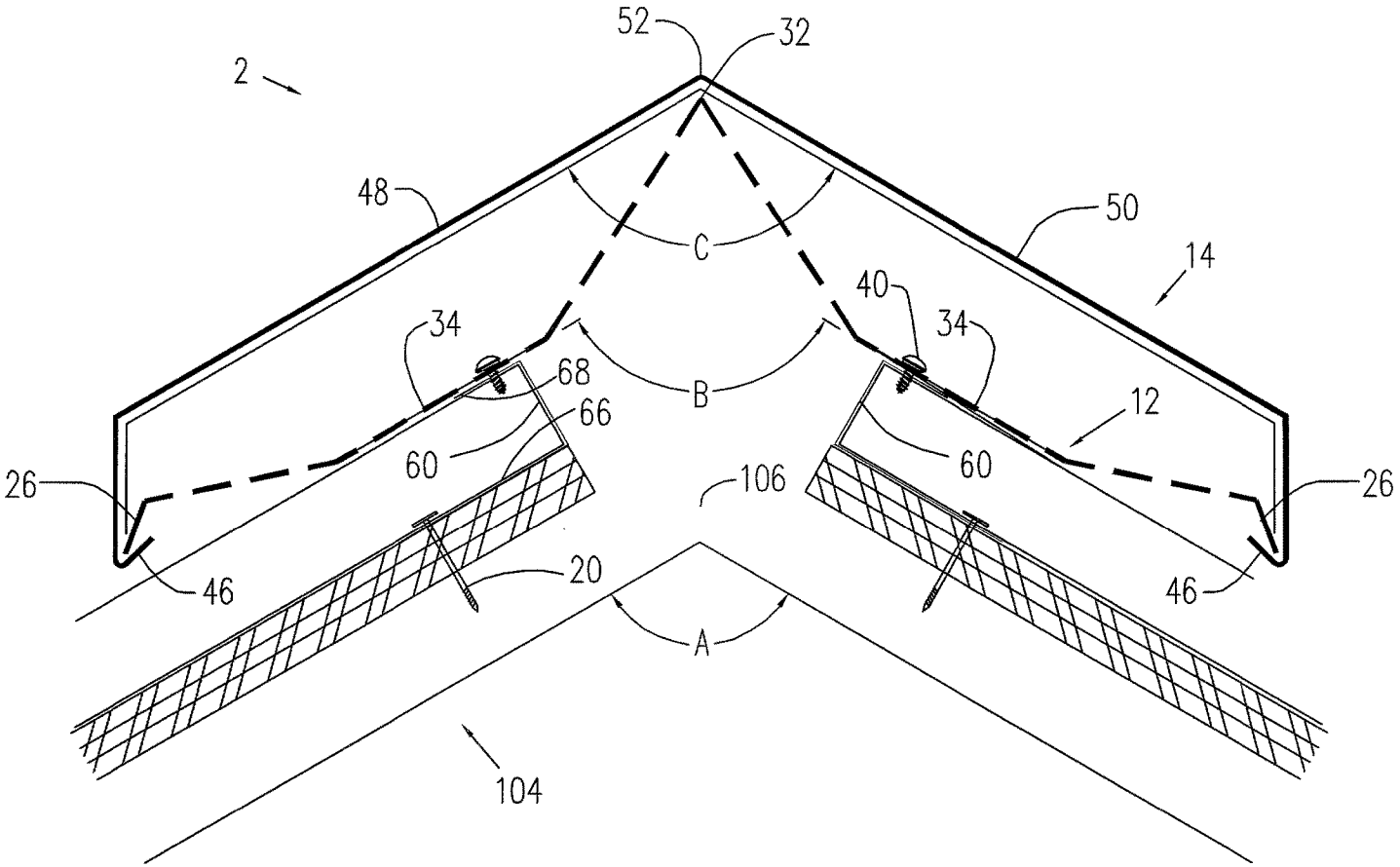
FIG. 16 is an end view of a second embodiment of a customizable ridge ventilator attached to a roof in accordance with the present invention.
Figure 17:
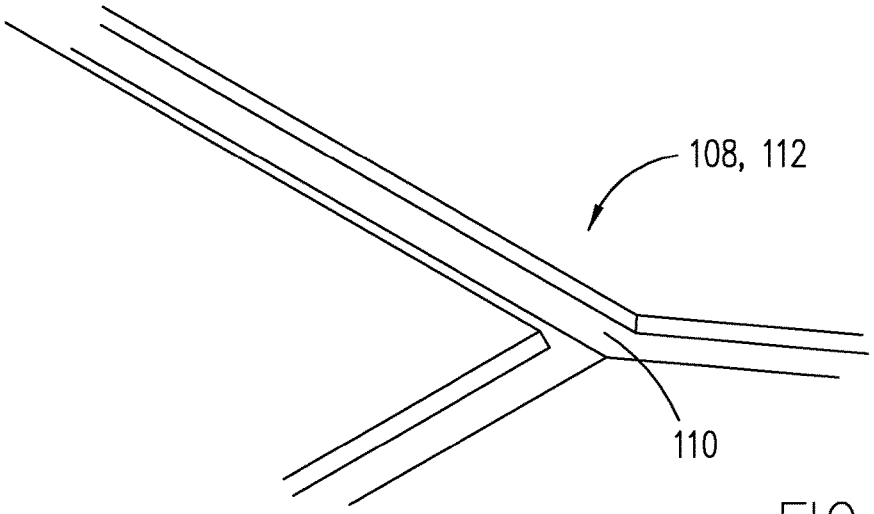
FIG. 17 is a perspective view of a roof with a ventilation opening for attachment of a high snow-load ridge ventilator in accordance with the present invention.
Figure 18:
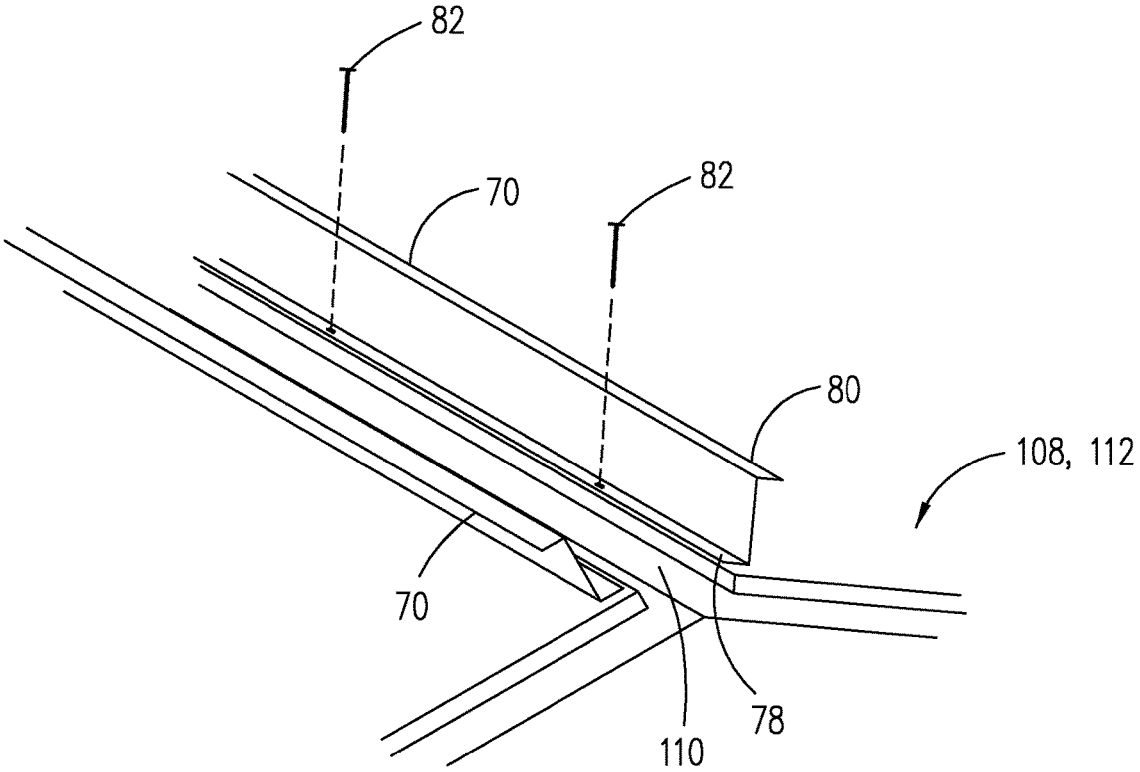
FIG. 18 is a perspective view of a pair of support brackets positioned on a roof for attachment of a high snow-load ridge ventilator in accordance with the present invention.

With reference to FIG. 16, a second embodiment of the customizable ridge ventilator 2 includes a pair of support brackets 60, the perforated support 12 and the ridge cover 14, which are structured for attachment to a corrugated roof 104. With reference to FIGS. 9-11, the bottom flange 66 is attached to a top of the corrugated roof 104 with a plurality of fasteners 20. One support bracket 60 is attached to one side of a ventilation opening 106 and the other support bracket 60 is attached to the other side of the ventilation opening 106, such that the open ends face away from each other. The open end of each support bracket 60 is sized to receive a thickness of a corrugated roof panel 108.

Figure 14:
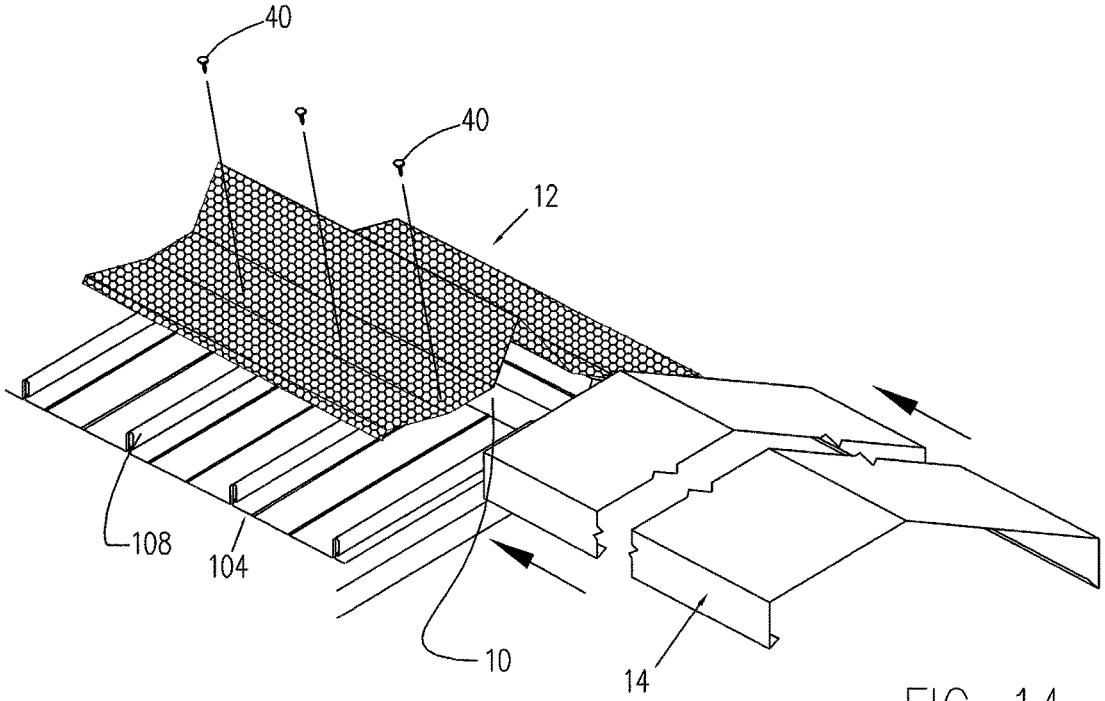
FIG. 14 is a perspective view of a ridge cover adjacent a perforated support of a second embodiment of a customizable ridge ventilator in accordance with the present invention.

The perforated support 12 is attached to a top bracket 68 of the pair of support brackets 10 by inserting a plurality of threaded fasteners 40 through the bracket members 34 and threading the plurality of threaded fasteners 40 into the top flanges 68 of the support brackets 60. With reference to FIG. 14, the pair of snap clips 46 of the ridge cover 14 are slid over the pair of snap flanges 26 of the perforated support 12. The face peak 32 supports an underside of the cover peak 52.

Figure 12:
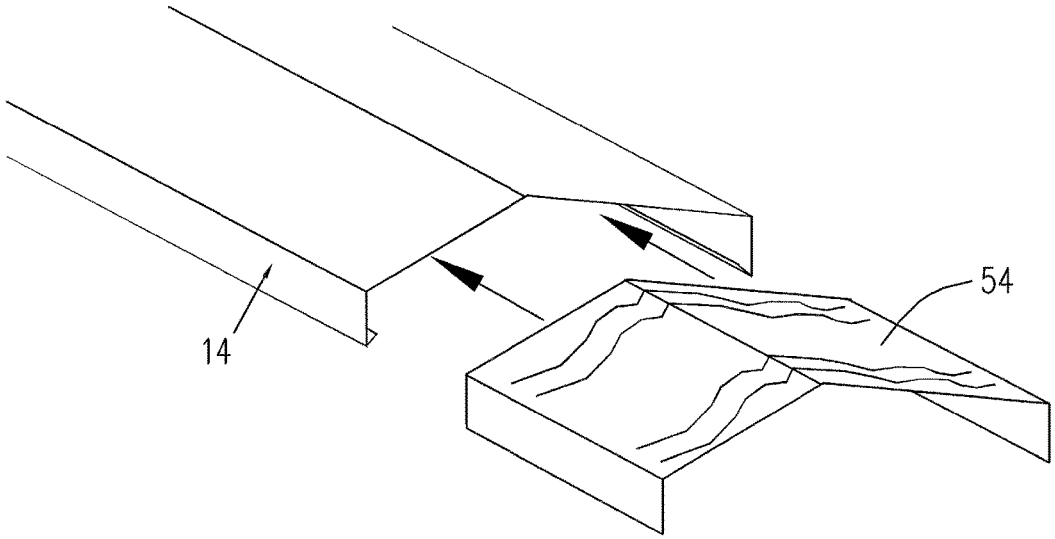
FIG. 12 is a perspective view of a cover splice adjacent a ridge cover of a second embodiment of a customizable ridge ventilator in accordance with the present invention.
Figure 13:
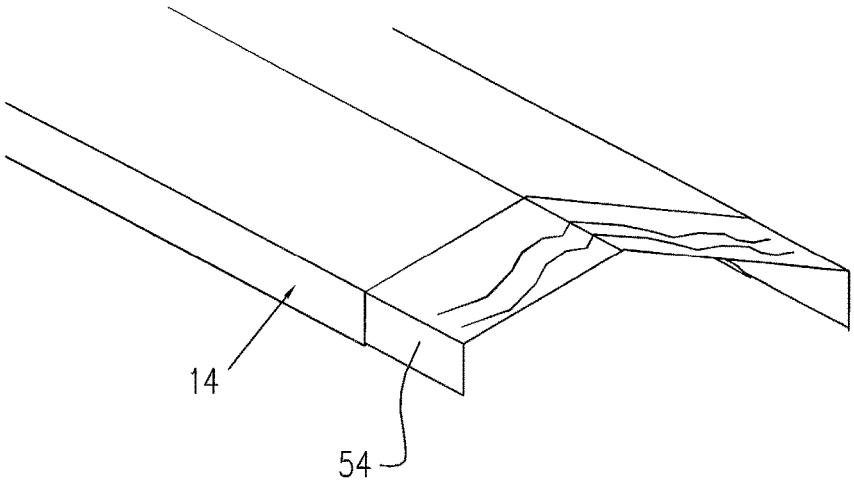
FIG. 13 is a perspective view of a cover splice inserted into a ridge cover of a second embodiment of a customizable ridge ventilator in accordance with the present invention.
Figure 15:
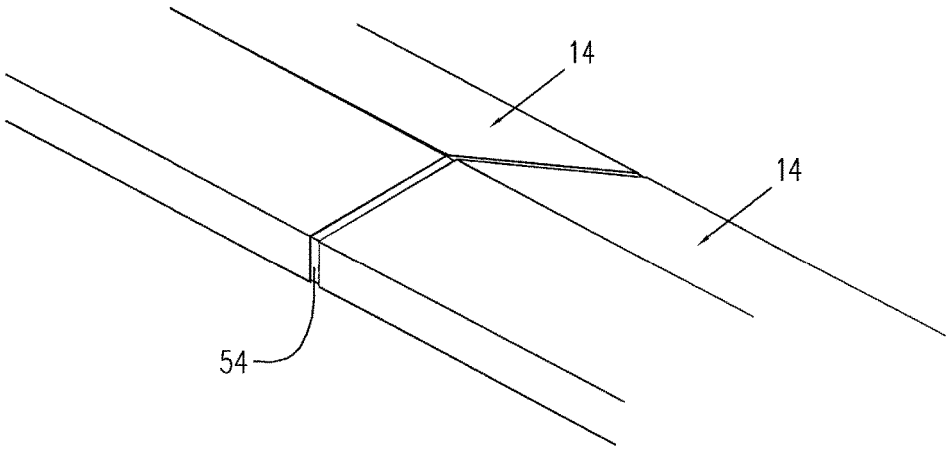
FIG. 15 is a perspective view of two adjacent ridge covers engaged with a cover splice of a second embodiment of a customizable ridge ventilator in accordance with the present invention.

With reference to FIG. 16, the included angle "A" of the roof 104 is preferably replicated during manufacture of the customizable roof ventilator 2 by defining the included angle "B" of the bracket members 34 of the perforated support 12 as "B"="A" and by defining the included angle "C" of the first and second faces of the ridge cover 14 as "C"="A." With reference to FIGS. 12-13 and 15, two adjacent ridge 14 covers are connected to each other with the cover splice 54.

With reference to FIGS. 17-18, 26 and 26*a*, a high snow-load ridge ventilator 3 includes a pair of support brackets 70, a perforated support 72, a ridge cover 74 and a plurality of cover spacers 76. Each support bracket 70 has a substantial Z-shaped cross section. A bottom flange 78 of the support bracket 70 extends in a direction opposite of a top flange 80 of the support bracket 70. The bottom flange 78 is attached to a top of the roof 108, 112 with a plurality of fasteners 82. One support bracket 70 is attached to one side of a ventilation opening 110 and the other support bracket 70 is attached to the other side of the ventilation opening 110.

Figure 19:
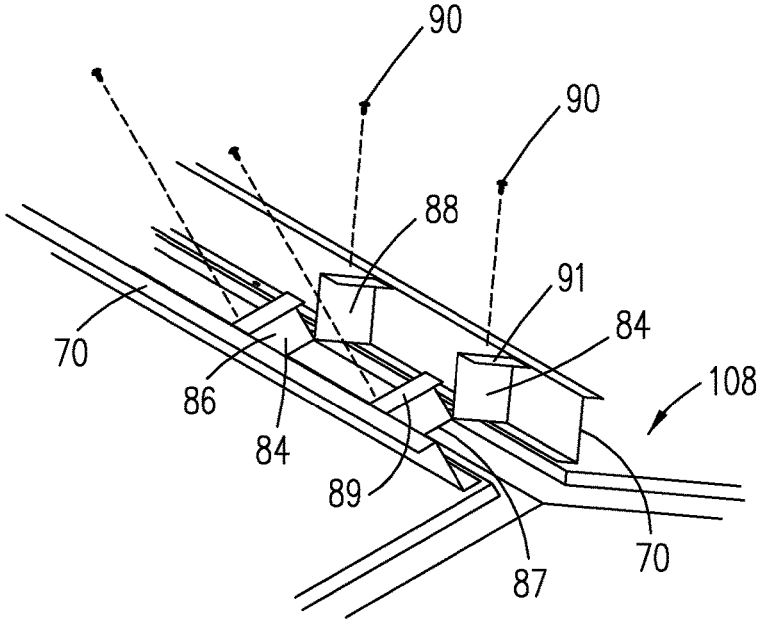
FIG. 19 is a perspective view of a plurality of perforated support spacers positioned on a roof between a pair of support brackets of a high snow-load ridge ventilator in accordance with the present invention.

With reference to FIG. 19, a plurality of perforated support spacers 84 may be attached to the roof 108 along a length of each support bracket 70 to provide the high snow-load ridge ventilator 3 with additional load carrying capability. The plurality of perforated spacers 84 are oriented substantially perpendicular to a length of the pair of support brackets 70. Each perforated support spacer 84 includes a first spacer portion 86 and a second spacer portion 88. The first and second spacer portions are joined by a common bottom flange 87. The common bottom flange 87 is bent in a middle to form an included angle C to substantially match the included angles A, B of roofs 108, 112. The first and second spacer portions have a substantial Z-shaped cross section. The common bottom flange 87 of the first and second spacer portions extends in a direction opposite of a first top flange 89 of the first spacer portion 86 and a second top flange 91 of the second spacer portion 88. Each end of the common bottom flange 86 is preferably attached to a top of the roof 108 with a plurality of fasteners 90.

Figure 20:
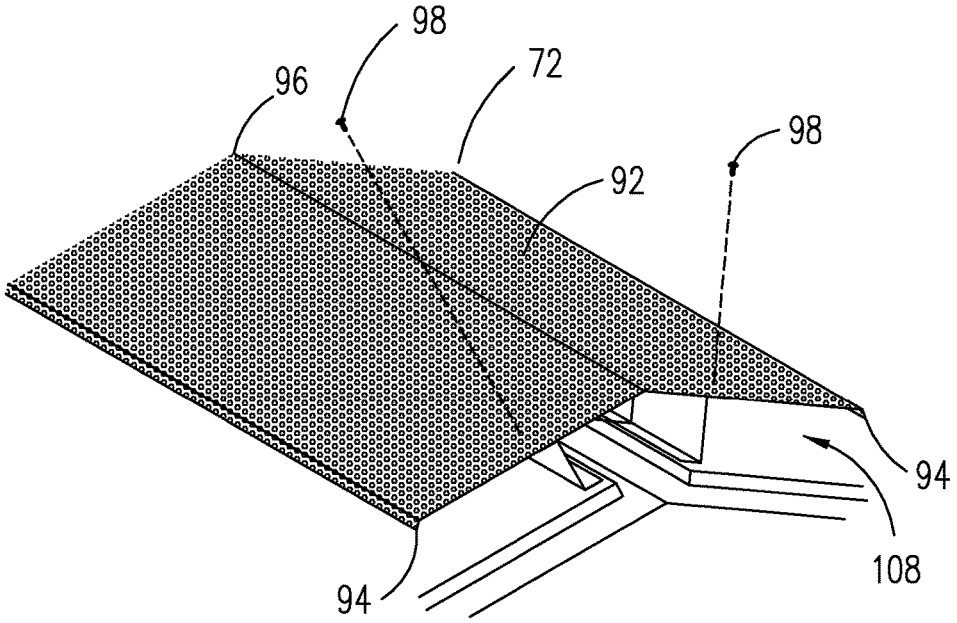
FIG. 20 is a perspective view of a perforated support positioned on a pair of support brackets of a high snow-load ridge ventilator in accordance with the present invention.

With reference to FIG. 20, the perforated support 72 is a formed plate with a plurality of perforated openings. The plurality of openings are preferably formed through an entire surface area of the formed plate. However, the plurality of perforated openings could also be formed through substantially all of the surface area of the formed plate. It is preferable that the plurality of perforated openings remove material from 45-55% of the formed plate. The perforated support 72 preferably includes a cross section with a pair of legs 92 and a pair of snap flanges 94. One end of each leg 92 meets the other to form a peak 96. It is preferable that the included angle D of the pair of legs 92 substantially match the included angle A, B of the roof 108, 112. A single snap flange 94 extends downward from the other end of each leg 92. The perforated support 72 is attached to a top of the pair of support brackets 70 and preferably the plurality of perforated spacers 84 (if used) by inserting a plurality of threaded fasteners 98 through the perforated support 72 and threading the plurality of threaded fasteners 98 into the top flanges 80 of the pair of support brackets 70 and the top flanges 89, 91 of the plurality of perforated spacers 84.

Figure 19A:
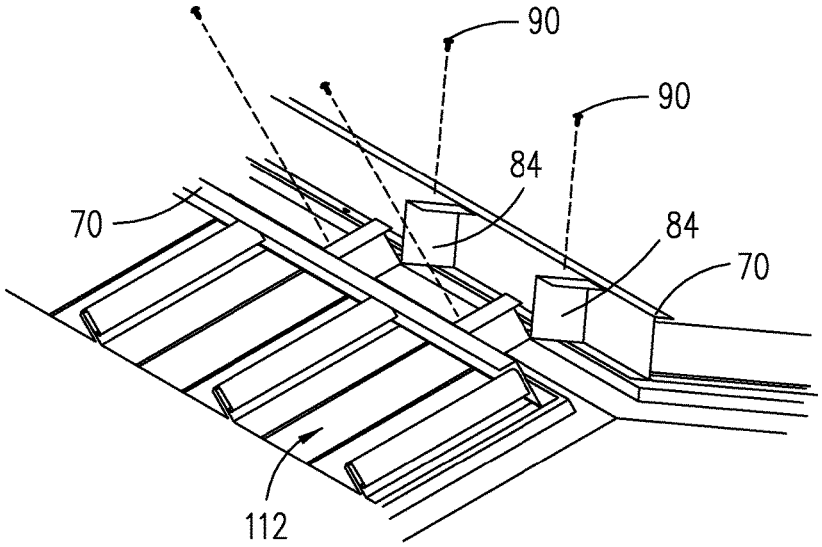
FIG. 19*a* is a perspective view of a plurality of perforated support spacers positioned on a standing seam roof between a pair of support brackets of a high snow-load ridge ventilator in accordance with the present invention.
Figure 20A:
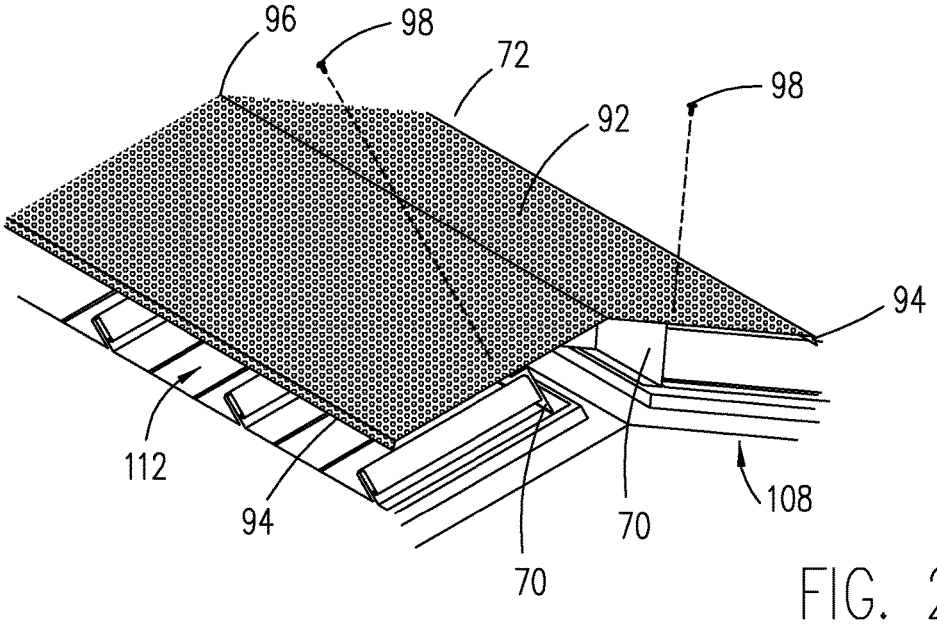
FIG. 20*a* is a perspective view of a perforated support positioned on a pair of support brackets of a high snow-load ridge ventilator on a standing seam roof in accordance with the present invention.

With reference to FIG. 19*a*, the plurality of perforated support spacers 84 are preferably attached to the standing seam roof 112 by attaching the common bottom flanges 87 to a top of the standing seam roof 112 with the plurality of fasteners 90. With reference to FIG. 20*a*, the perforated support 72 is attached to a top of the pair of support brackets 70 and the plurality of perforated spacers 84 (if used) by inserting the plurality of threaded fasteners 98 through the perforated support 72 and threading the plurality of threaded fasteners 98 into the top flanges 80 of the pair of support brackets 70 and the top flanges 89, 91 of the plurality of perforated spacers 84.

Figure 21:
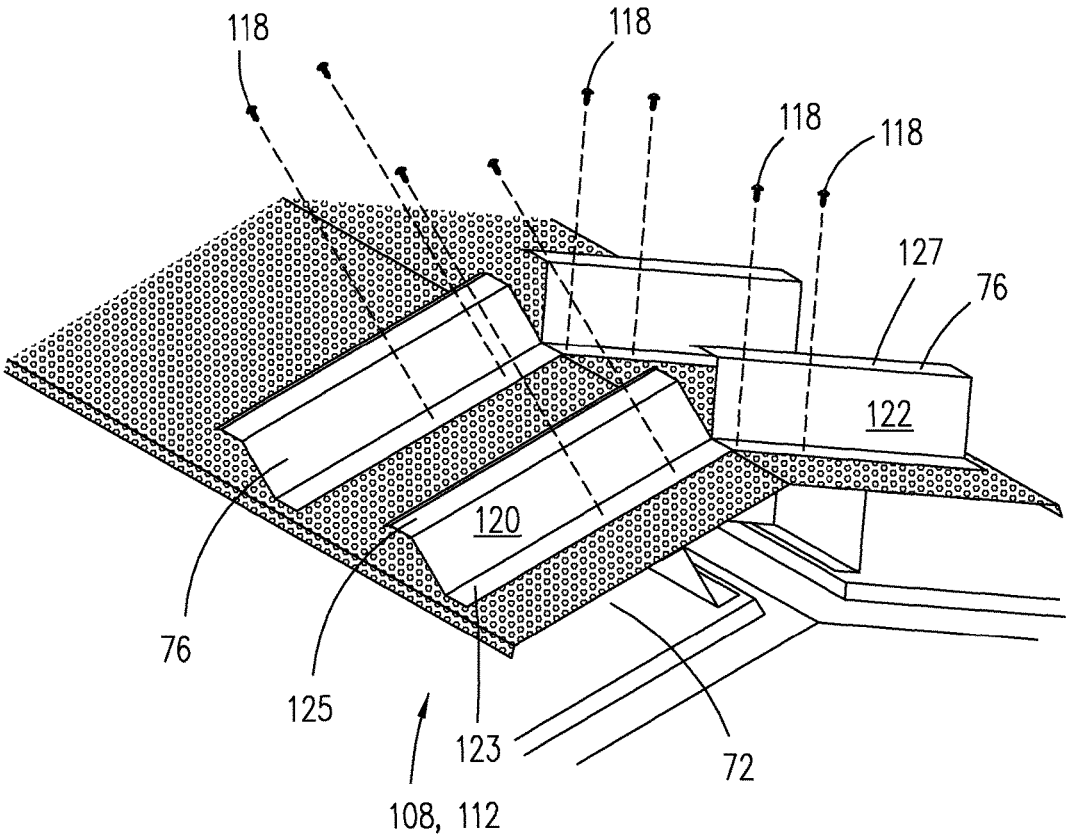
FIG. 21 is a perspective view of a plurality of cover spacers positioned on a perforated support of a high snow-load ridge ventilator in accordance with the present invention.

With reference to FIG. 21, the plurality of cover spacers 76 are preferably attached to a top of the perforated support 72 with a plurality of fasteners 118. The plurality of cover spacers 76 are oriented substantially perpendicular to a length of the pair of support brackets 70. The plurality of cover spacers 76 provide the high snow-load ridge ventilator 3 with additional load carrying capability. Each cover spacer 76 includes a first spacer portion 120 and a second spacer portion 122. The first and second spacer portions are joined by a common bottom flange 123. The common bottom flange 123 is bent in a middle to form an included angle D to substantially match the included angles A, B of roofs 108, 112. The first and second spacer portions have a substantially Z-shaped cross section. The common bottom flange 123 of the first and second spacer portions extends in a direction opposite of a first top flange 125 of the first spacer portion 120 and a second top flange 127 of the second spacer portion 122. The common bottom flange 123 is preferably attached to a top of the roof 108 with the plurality of fasteners 118.

Figure 24:
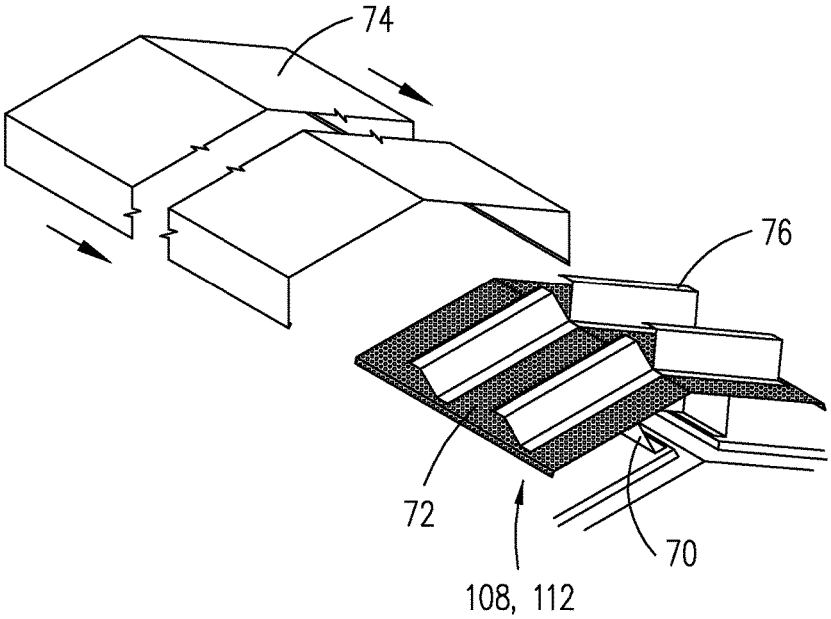
FIG. 24 is a perspective view of a ridge cover adjacent a perforated support with a plurality of cover spacers of a high snow-load ridge ventilator in accordance with the present invention.

The ridge cover 74 includes a sloped peak 124, two side legs 126 and a pair of snap clips 128. The sloped peak 124 includes a first face 125 and a second face 127 that meet at a cover peak 130. It is preferable that an included angle E of the first and second faces matches the included angle C of the pair of legs 92 of the perforated support 72. One end of a single side leg 126 extends downward from each face of the sloped peak 124. Each side leg 126 is terminated with a snap clip 128. With reference to FIG. 24, the pair of snap clips 128 of the ridge cover 74 are slid over the pair of snap flanges 26 of the perforated support 72 and the plurality of cover spacers 76.

Figure 24A:
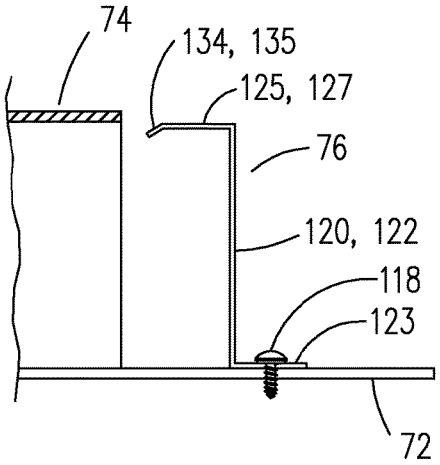
FIG. 24*a* is a side view of a ridge cover adjacent a cover spacer of a high snow-load ridge ventilator in accordance with the present invention.
Figure 26:
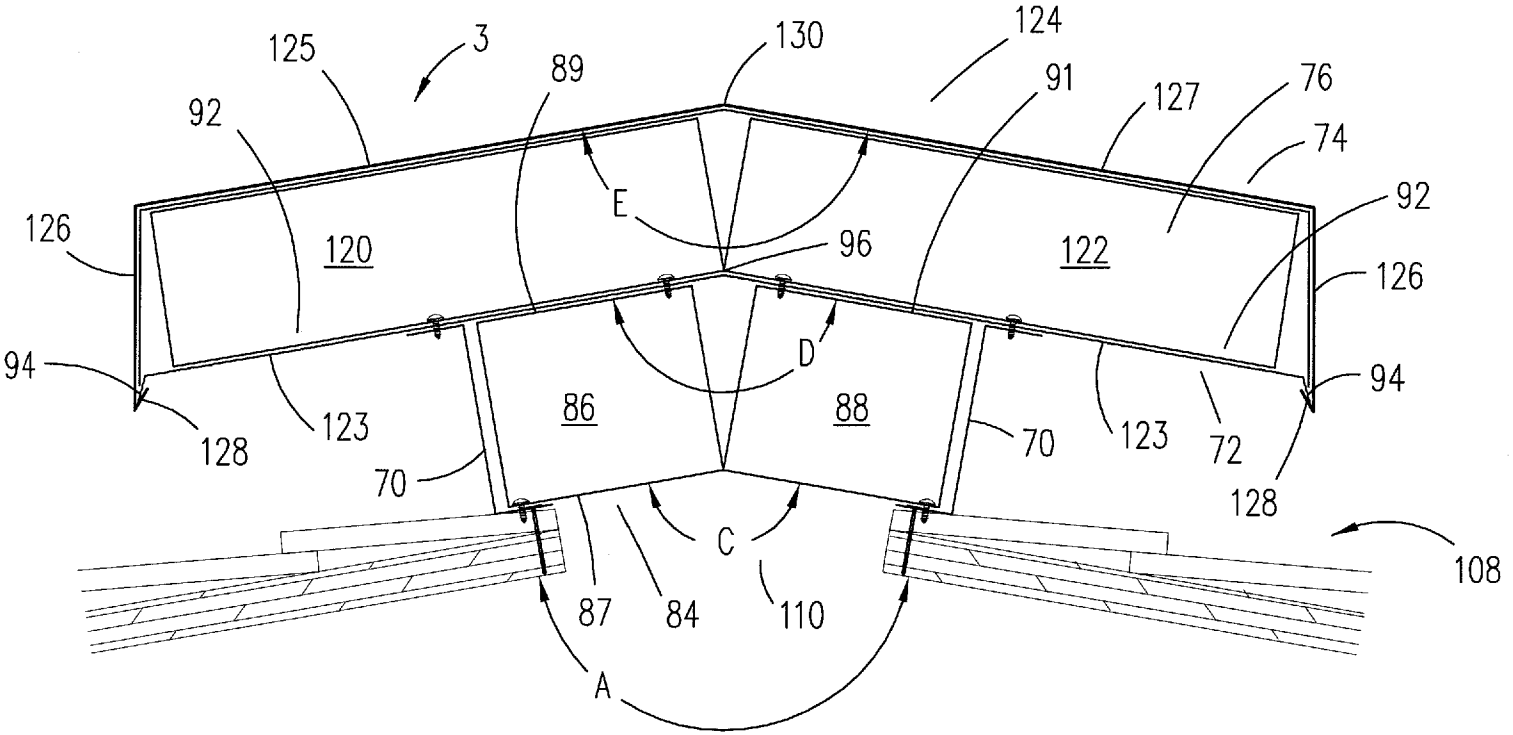
FIG. 26 is an end view of a high snow-load ridge ventilator attached to a roof in accordance with the present invention.
Figure 26A:
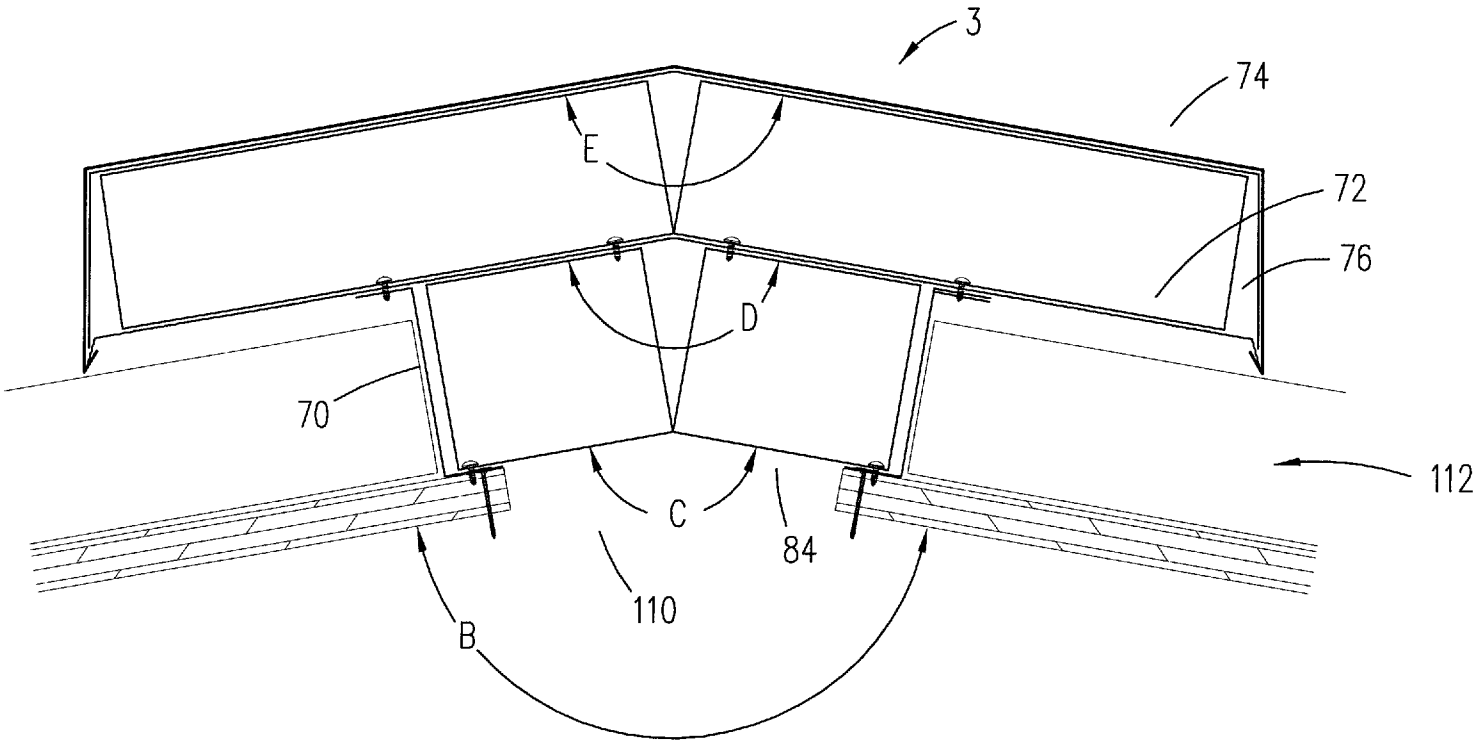
FIG. 26*a* is an end view of a high snow-load ridge ventilator attached to a standing seam roof in accordance with the present invention.

With reference to FIG. 24*a*, a first end portion 134 of the first spacer portion 120 and a second end portion 135 of the second spacer portion 122 is bent downward to facilitate sliding the ridge cover 74 over each cover spacer 76. FIG. 26*a* shows the high snow-load ridge ventilator 3 attached to the standing seam roof 112.

Figure 22:
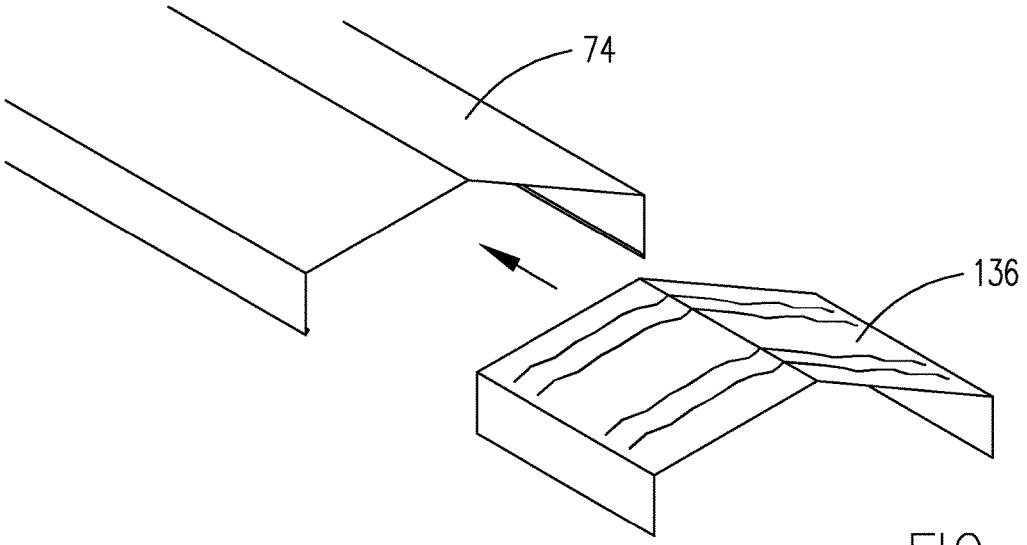
FIG. 22 is a perspective view of a cover splice adjacent a ridge cover of a high snow-load ridge ventilator in accordance with the present invention.
Figure 23:
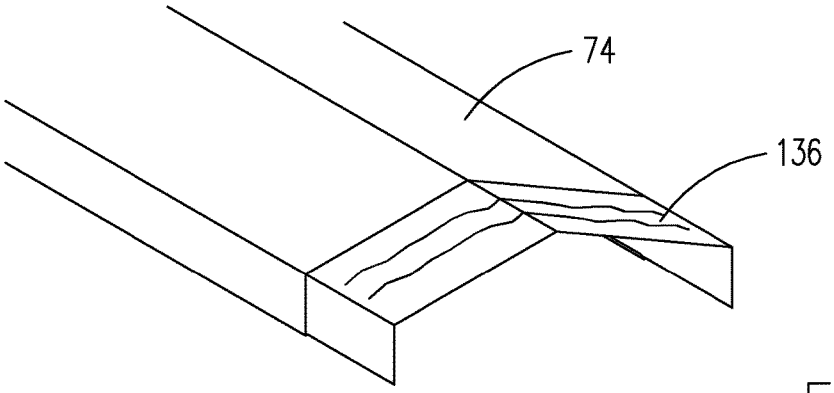
FIG. 23 is a perspective view of a cover splice inserted into a ridge cover of a high snow-load ridge ventilator in accordance with the present invention.
Figure 25:
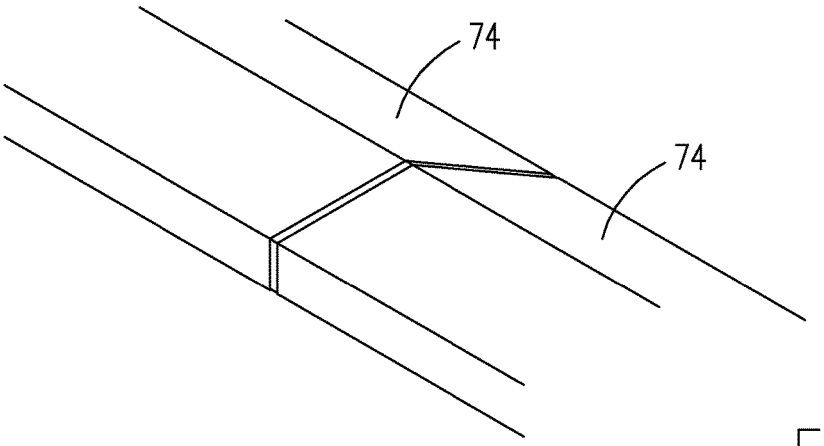
FIG. 25 is a perspective view of two adjacent ridge covers engaged with a cover splice of a high snow-load ridge ventilator in accordance with the present invention.

With reference to FIGS. 22-23, a cover splice 136 includes a cross section that has the same shape as the ridge cover 74. However, the cover splice 136 does not include a pair of snap clips 132. The cover splice 136 is sized to be received by an inner perimeter of the ridge cover 74. With reference to FIG. 25, two adjacent ridge covers 74 are connected to each other with the cover splice 136.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A high snow-load ridge ventilator for a roof, further comprising:

a first support bracket for attachment to the roof;

a second support bracket for attachment to the roof;

a plurality of perforated support spacers each includes a support planar surface, said support planar surface is perpendicular to a ridge of a roof and to a top surface of the roof, at least one of said plurality of perforated support spacers includes a first spacer portion and a second spacer portion, a common bottom flange joins said first and second spacer portions;

a perforated support for attachment to a top of said first and second support brackets and said plurality of perforated support spacers, said perforated support including a plurality of openings;

a plurality of cover spacers each includes a cover planar surface, said cover planar surface is perpendicular to a ridge of a roof and to a top surface of the roof, at least one of said plurality of cover spacers includes a first cover spacer portion and a second cover spacer portion, a common bottom flange joins said first and second cover spacer portions;

a ridge cover is engaged with said perforated support, said plurality of cover spacers are retained between said perforated support and said ridge cover, said plurality of cover spacers support said ridge cover.

2. The high snow-load ridge ventilator for a roof of claim 1 wherein:

said plurality of cover spacers are substantially perpendicular to a length of said first and second support brackets.

3. The high snow-load ridge ventilator for a roof of claim 1, further comprising:

a pair of snap flanges extending from each end of said perforated support.

4. The high snow-load ridge ventilator for a roof of claim 3, further comprising:

said ridge cover includes a sloped peak, two side legs and a pair of snap clips, one of said two side legs extends from each end of said sloped peak, a pair of snap clips extend from each one of said two side legs, said pair of snap clips for engagement with said pair of snap flanges.

5. The high snow-load ridge ventilator for a roof of claim 4, further comprising:

said sloped peak includes a first face and a second face that meet at a cover peak.

6. The high snow-load ridge ventilator for a roof of claim 1, further comprising:

said first and second support bracket having substantially Z-shaped cross sections.

7. The high snow-load ridge ventilator for a roof of claim 1, further comprising:

each one of said cover spacers having a substantially Z-shaped cross section.

8. A high snow-load ridge ventilator for a roof, further comprising:

a first support bracket for attachment to the roof;

a second support bracket for attachment to the roof;

a plurality of perforated support spacers each includes a support planar surface, said support planar surface is perpendicular to a ridge of a roof and to a top surface of the roof, at least one of said plurality of perforated support spacers includes a first spacer portion and a second spacer portion, a common bottom flange joins said first and second spacer portions, a bottom of said first and second spacer portions are in contact with each other;

a perforated support for attachment to a top of said first and second support brackets and said plurality of perforated support spacers, said perforated support including a plurality of openings, said plurality of openings cover substantially all of a surface area of said perforated support;

a plurality of cover spacers each includes a cover planar surface, said cover planar surface is perpendicular to a ridge of a roof and to a top surface of the roof, at least one of said plurality of cover spacers includes a first cover spacer portion and a second cover spacer portion, a common bottom flange joins said first and second cover spacer portions; and a ridge cover is engaged with said perforated support, said plurality of cover spacers are retained between said perforated support and said ridge cover, said plurality of cover spacers support said ridge cover.

9. The high snow-load ridge ventilator for a roof of claim 8 wherein:

said plurality of cover spacers are substantially perpendicular to a length of said first and second support brackets.

10. The high snow-load ridge ventilator for a roof of claim 8, further comprising:

a pair of snap flanges extending from each end of said perforated support.

11. The high snow-load ridge ventilator for a roof of claim 10, further comprising:

said ridge cover includes a sloped peak, two side legs and a pair of snap clips, one of said two side legs extends from each end of said sloped peak, a pair of snap clips extend from each one of said two side legs, said pair of snap clips for engagement with said pair of snap flanges.

12. The high snow-load ridge ventilator for a roof of claim 11, further comprising:

said sloped peak includes a first face and a second face that meet at a cover peak.

13. A high snow-load ridge ventilator for a roof, further comprising:

a first support bracket for attachment to the roof;

a second support bracket for attachment to the roof;

a plurality of perforated support spacers are retained between said first and second support brackets, at least one of said plurality of perforated support spacers each includes a support planar surface, said support planar surface is perpendicular to a ridge of a roof and to a top surface of the roof at least one of said plurality of perforated support spacers includes a first spacer portion and a second spacer portion, a common bottom flange joins said first and second spacer portions a bottom of said first and second spacer portions are in contact with each other;

a perforated support for attachment to a top of said first and second support brackets, said perforated support including a plurality of openings;

a plurality of cover spacers each includes a cover planar surface, said cover planar surface is perpendicular to a ridge of a roof and to a top surface of the roof, at least one of said plurality of cover spacers includes a first cover spacer portion and a second cover spacer portion, a common bottom flange joins said first and second cover spacer portions a bottom of said first and second cover spacer portions are in contact with each other; and a ridge cover is engaged with said perforated support, said plurality of cover spacers are retained between said perforated support and said ridge cover, said plurality of cover spacers support said ridge cover.

14. The high snow-load ridge ventilator for a roof of claim 13, further comprising:

at least one of said plurality of perforated support spacers includes a first spacer portion and a second spacer portion, a common bottom flange joins said first and second spacer portions.

15. The high snow-load ridge ventilator for a roof of claim 13 wherein:

said plurality of perforated support spacers are substantially perpendicular to a length of said first and second support brackets.

16. The high snow-load ridge ventilator for a roof of claim 13, further comprising:

said plurality of cover spacers are substantially perpendicular to a length of said first and second support brackets.

17. The high snow-load ridge ventilator for a roof of claim 13, further comprising:

said plurality of perforated support spacers having a substantially Z-shaped cross section.

* * * * *